US006105627A

United States Patent [19]

Covelli

[11] Patent Number: 6,105,627

[45] Date of Patent: Aug. 22, 2000

[54] METHOD TO CONTROL WEFT YARN INSERTION IN A LOOM

[75] Inventor: Marco Covelli, Occhieppo Inferiore, Italy

[73] Assignee: Nuova ROJ Electrotex S.r.L., Biella, Italy

[21] Appl. No.: 09/230,748

[22] PCT Filed: Jul. 18, 1997

[86] PCT No.: PCT/EP97/03851

§ 371 Date: Feb. 1, 1999

§ 102(e) Date: Feb. 1, 1999

[87] PCT Pub. No.: WO98/05812

PCT Pub. Date: Feb. 12, 1998

[30] Foreign Application Priority Data

Jul. 31, 1996 [IT] Italy ..... MI96A01649

[51] Int. Cl.[7] ..... D03D 47/34

[52] U.S. Cl. ..... 139/450; 139/194

[58] Field of Search ..... 139/194, 450

[56] References Cited

U.S. PATENT DOCUMENTS

| | | | |
|---|---|---|---|
| 4,962,796 | 10/1990 | Grimm et al. | 139/194 |
| 4,967,807 | 11/1990 | Lewyllie et al. | 139/450 |
| 5,050,648 | 9/1991 | Pezzoli | 139/450 |
| 5,417,251 | 5/1995 | Josefsson et al. | 139/450 |
| 5,476,122 | 12/1995 | Schuster et al. | 139/194 |
| 5,501,250 | 3/1996 | Edwards et al. | 139/194 |
| 5,725,029 | 3/1998 | Loehr et al. | 139/194 |

FOREIGN PATENT DOCUMENTS

| | | |
|---|---|---|
| 0 155 431 | 9/1985 | European Pat. Off. . |
| 0 239 055 | 9/1987 | European Pat. Off. . |
| 0 356 380 | 2/1990 | European Pat. Off. . |
| 0 357 975 | 3/1990 | European Pat. Off. . |
| WO 93/06279 | 4/1993 | WIPO . |

*Primary Examiner*—Andy Falik
*Attorney, Agent, or Firm*—Young & Thompson

[57] ABSTRACT

During weft yarn insertion in a loom, as the end of weft yarn insertion approaches, a controllable yarn deviation brake (B), positioned between a weft feeder (M) and a warp shed (F) of a loom (D) brakes the weft yarn (Y) with a high braking force, causing a deviation of the yarn deviation brake which subsequently smooths down a tension peak of the yarn, so as to partially reduce the yarn brake deviation back towards the starting position, or position having no deviation. The same function is performed upon cutting of the weft yarn (Y). After braking and reduction of the yarn tension peak, during the weft insertion step, the braking force is reduced to a level correlated to the yarn tension which prevails up to cutting of the weft yarn (Y).

11 Claims, 2 Drawing Sheets

FIG. 1
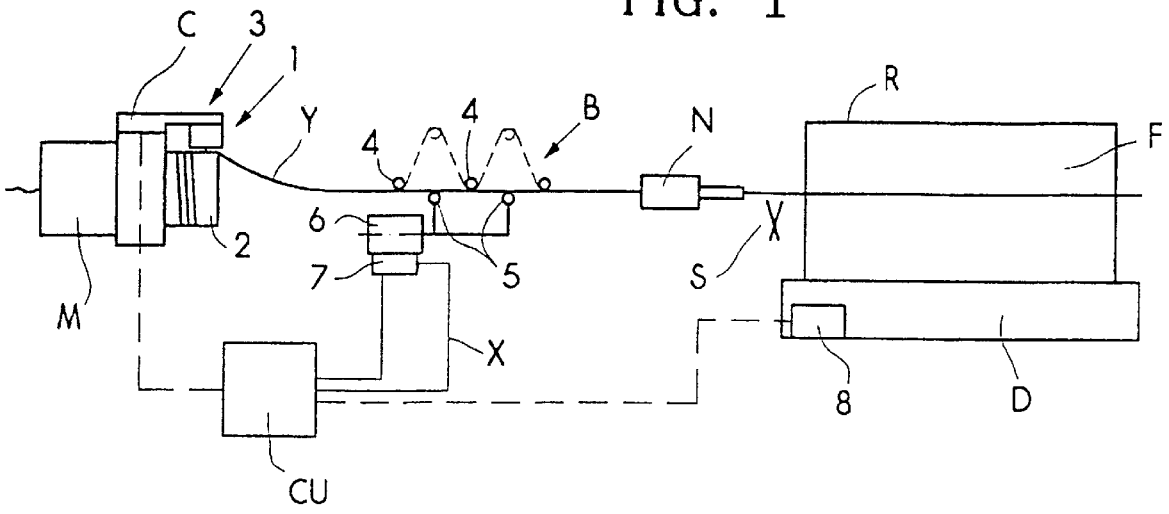
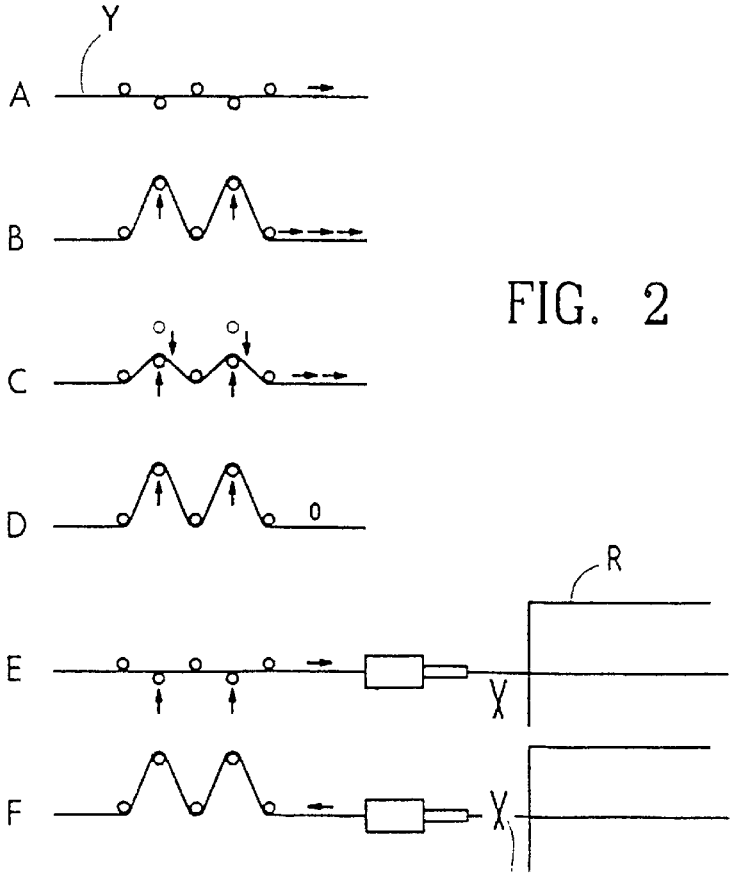
FIG. 2

Tension Y
9
9'
A
0°
360°/0°
t
Shift
max
0
10
B
I+
I1
I1'
11
C
I2
t0
t1
t2
t3
t3
I3
I-
V
a
b
c
90°
360°/0°
t
D
V
d
X
t.
t

METHOD TO CONTROL WEFT YARN INSERTION IN A LOOM

BACKGROUND OF THE INVENTION

The present invention relates to a method of controlling weft yarn insertion in a loom, as well as to a weft yarn deviation brake.

In a method of this type—as disclosed by U.S. Pat. No. 4,962,976—the magnetic core of an electromagnetic linear control system of the yarn deviation brake is shifted, in order to brake the weft yarn by means of the braking element, with a maximum of deviation. As soon as braking with a sharp tension peak occurs towards the end of weft yarn insertion, a high increase in yarn tension takes place due to stopping of the weft yarn drawn from the weft feeder of the loom. The current of the electromagnetic control system is already regulated so that, after a braking, the weft yarn with its reaction force pushes back the braking element, reacting to the braking force, whereby due to smoothing down of the tension peak, there is an absorption of kinetic energy. In other words, the current is regulated so that the braking element which, to start with, is actually shifted with a maximum deviation (i.e. reaches its position of maximum deviation), can subsequently again be moved backward, at least partially, from its position of maximum deviation, due to the reaction force of the yarn, thereby producing a smoothing down effect. Alternatively, due to shifting of the braking element into its position of maximum deviation or rotation, a higher startup current is temporarily set. In both cases, after smoothing down, the yarn deviation or rotation brake takes up again its position of maximum deviation as a result of the braking force.

As disclosed by EP-B-239,055, when the weft yarn is cut at the end of its insertion into the loom, it is known to prevent the weft yarn—which is tensioned by moving of the reed—from bouncing backward as far as the yarn reserve wound on the drum of the weft feeder, that is, to prevent backward oscillations from being produced in the weft yarn, causing the loosening thereof. At the outlet of the weft feeder, in correspondence to the yarn drawing point, there is mounted a yarn deviation element apt to be shifted in a controlled manner along the yarn path, which element, upon cutting of the yarn, is moved into a position of yarn deviation. Friction points are created for the yarn in the position of yarn deviation and the yarn is braked with an increasing braking force, giving rise to a recoil or a spring-back. During weft insertion, the yarn deviation element is kept in a position of no deviation up to the moment of yarn cutting. In any case, this method requires an extremely precise control of the yarn deviation element.

SUMMARY OF THE INVENTION

The object of the present invention is to therefore supply a method allowing to obtain, in the final step of weft yarn insertion, an extremely precise and delicate control of the weft yarn, apt to be carried out with simple and economic means, and to also supply a weft yarn deviation brake to allow practice of the method.

By reducing the braking force in respect of the braking force applied for braking and damping, in the relatively long period of time in which the reed performs it. movement to press the weft yarn in position inside the ware shed, the yarn deviation brake is set in a weaker operating condition in which it is thus allowed to automatically react to the reaction force determined by the yarn tension increase during movement of the reed, before cutting and, subsequently, upon dropping of the yarn tension when cutting takes place, so that—in a particularly advantageous way—it is the actual weft yarn which determines the functional unwinding. This means that the reduced braking force is suitably adjusted or set by the control system at the most appropriate moment, before the actual weft yarn causes the yarn deviation brake to act, in the manner which proves to be advantageous for the precise control of the yarn in the final weft insertion step. The reduced braking force derives from the fact that the yarn tension increase, due to movement of the reed, due to movement of the reed, is considerably weaker than the previous tension peak which also was required to be smoothed down and, furthermore, it is not apt to move, with the reaction force acting on the weft yarn, the yarn deviation brake into a starting position, or position of no deviation, under the highest braking force. The position of no deviation, or a similar position, is however appropriate to allow withdrawing the weft yarn as much as possible after cutting. By adjusting the reduced braking force, the yarn deviation brake is made so sensitive and precise as to automatically react to the weft yarn tension increase occurring during motion of the reed thereby yielding, up to possibly even moving back into starting position of no deviation and, in synchronism with yarn cutting, to brake with a new strong deviation when the free weft yarn end is simultaneously withdrawn. It would be detrimental to leave the yarn deviation brake constantly in position of maximum deviation, starting from the braking action, or from the smoothing down action, up to cutting; and this due to the fact that, after cutting, the free weft yarn end would extend too much beyond the weft insertion nozzle On the other hand, actively moving back the yarn deviation brake into its position of no deviation, after the braking action or after smoothing down the tension peak, would involve the drawback that the yearn deviation brake would then have to be again shifted in synchronism with the cutting operation which takes place in a fairly indefinite manner. The brake would in fact have to start its braking action only and exactly from the precise moment in which the weft yarn is actually cut, neither at an earlier nor at a later moment. According to the method of the present invention, a relatively long period of time is available to reduce the braking force. The weakest braking action of the yarn deviation brake, with the reduced braking force, automatically comes to an end as soon as the brake is moved back into a starting position of no deviation for the next weft insertion step. In spite of the high degree of precision and reliability required, the method of the present invention can be carried out in a simple way, and it ensures weft insertion steps with no problems or inconveniences, even in the presence of yarn qualities difficult to treat. The yarn deviation brake can perform an important multiple function in that, in spite of the simplicity of the respective control system, it contributes to braking and smoothing down the tension peak before the end of weft insertion, as well as to brake the yarn after cutting, and to withdraw the free weft yarn end. These functions—in themselves not tied one to the other—can be performed in a simple way using this technique of control, which has precision in a favorable point of the weft yarn path which may, in specific circumstances, find itself even fairly distant from the weft feeder of the loom.

BRIEF DESCRIPTION OF THE DRAWINGS

Preferred embodiments of the invention shall now be described hereinafter with reference to the accompanying drawings, in which:

FIG. 1 shows diagrammatically a system of weft yarn insertion in a loom;

FIGS. 2A to 2F illustrate different working conditions of the weft yarn deviation brake shown in FIG. 1.

DESCRIPTION OF THE PREFERRED EMBODIMENTS

Figure 3:
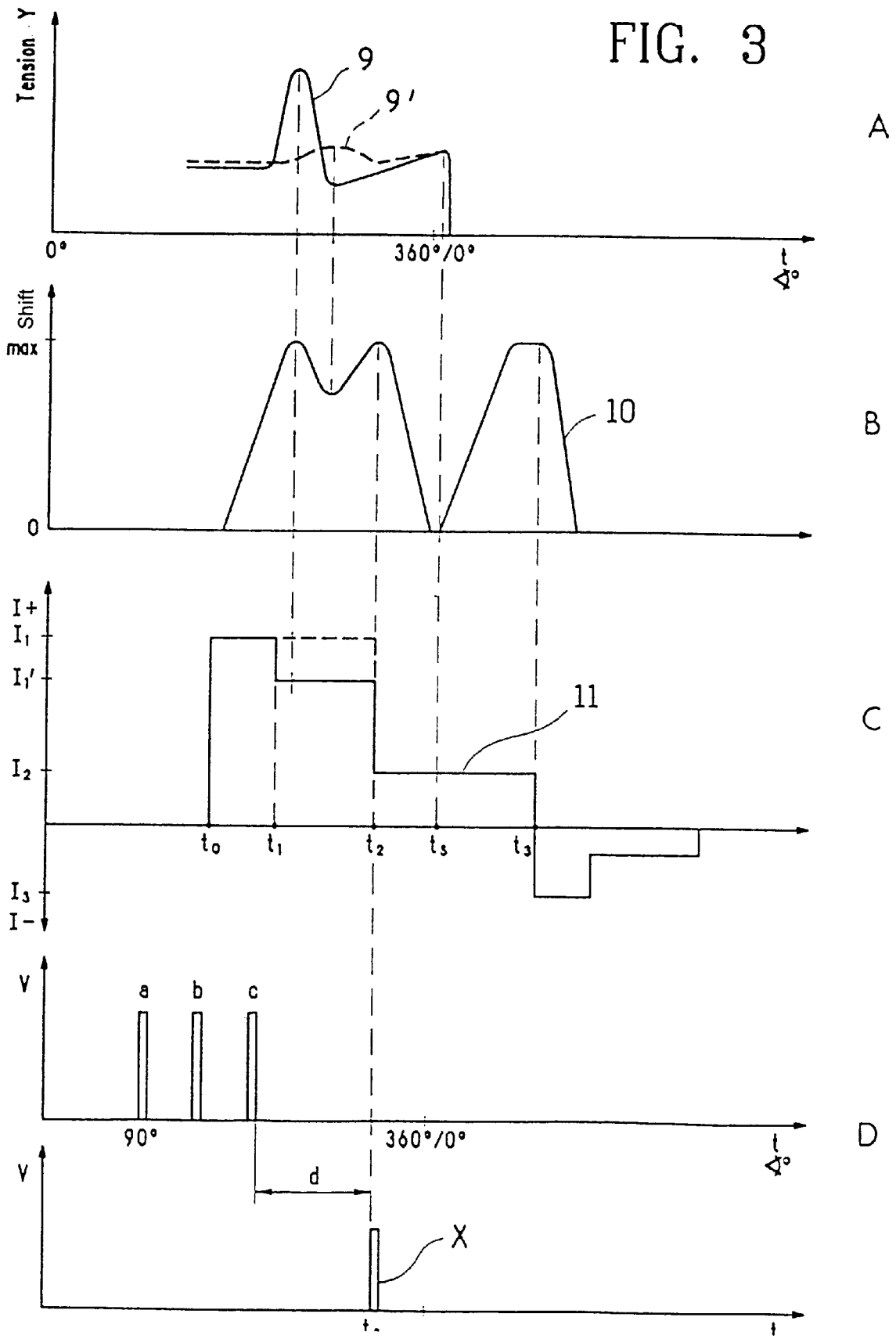
FIGS. 3A to 3D are four diagrams illustrating the yarn tension trend, the movement of the yarn deviation brake, the current absorbed, and a chain of signals, step after step according to the time or angle of rotation of the loom.

The fundamental components of a weft yarn insertion system as shown in FIG. 1, conceived to carry out the method according to the invention, are a loom D with a warp shed F and a movable reed R, operated in known manner, a weft feeder M to feed a weft yarn Y to the loom D, a weft insertion nozzle N and a controllable yarn deviation brake B. To the same loom D there could be simultaneously associated more weft feeders M, for feeding to the weft insertion nozzle N different or similar yarns to be inserted in the warp shed F.

The weft feeder M for the loom D is a so-called measuring weft feeder, on the storage drum 2 of which there is kept available a yarn reserve of suitable consistency, wound into turns, from which reserve the loom D then provides, time after time, to intermittently draw a predetermined weft yarn length according to the pattern being woven. The weft yarn length is set by a stop device 1 associated to the storage drum 2, which allows to draw, time after time, in a nonoperating condition, only a predetermined number of yarn turns, before stopping the weft yarn Y and blocking it in order to prevent a further drawing thereof. A sensor 3 for the yarn turns cooperates with the stop device 1 and, at the passage of each yarn turn being drawn, it issues a signal—sending it for instance to a control device C of the weft feeder M—to allow the prompt operation of the stop device 1. Between the weft insertion nozzle N and the warp shed F there is provided a cutting device S which cuts, time after time, the weft yarn Y after its insertion. The yarn deviation brake B has various fixed deviation points 4, on one side of the yarn path, and a braking element 5 with respective deviation elements (two in this particular embodiment) which can be shifted between the fixed deviation points 4, transversely to the yarn path, by means of a rotation control member 6—preferably an electromagnetic proportional actuator—from the shown starting position of no deviation, to the braking position of yarn deviation shown in dashed lines. To the rotation control member 6 there is associated a current regulation circuit 7, to which a reduction control signal X can be sent, for instance through a control device CU (or else directly from the weft feeder M or from the loom D), in order to set the highest braking force to a reduced braking force level, by reducing the current for the rotation control member 6, the reduced braking force corresponding to a fraction of the highest braking force of yarn deviation. The control device CU can be connected to the control device C of the weft feeder M, and/or to the loom D, in order to promptly operate the yarn deviation brake B during a weft insertion step. Suitably, a transducer or indicator 8 (encoder) of the loom is alternatively provided, which—according to a specific position of rotation, for instance of the main shaft of the loom D—issues an external signal, acting as reduction control signal X.

FIGS. 2A to 2F illustrate different working positions of the yarn deviation brake B of FIG. 1, the positions being adjustable—according to the method of the present invention—at each weft insertion step, or being determined by the reaction force of the deviated weft yarn Y.

During the main phase of the weft insertion step (with the stop device 1 at rest), the weft yarn Y in the yarn deviation brake B is neither deviated nor subjected to friction, in order to prevent slowing down the movement of the weft yarn being inserted into the loom shed. The yarn deviation brake B thus finds itself in its position of no deviation, or starting position. The braking element 5 is withdrawn. The weft yarn Y is inserted by the nozzle N into the warp shed F of the loom D in the direction indicated by the arrow (FIG. 2A).

More or less when the stop device 1 starts to operate, on reaching of the preset weft yarn length to be drawn, the yarn deviation brake B is shifted in the braking position of maximum deviation, as shown in FIG. 2B. Due to the friction applied on the yarn and to the deviating action, the weft yarn Y is thus braked, so as to prevent the stop device 1 from being left to slow down by itself the whole free weft yarn mass. The braking points are indicated by the single arrows pointing upwards.

When the weft yarn Y is intercepted in response to the stop device 1, due to sudden slowing down of the yarn, a very high tension peak is produced therein. The highest braking force of the yarn deviation brake B is actually regulated at that intensity, thereby allowing the reaction force of the weft yarn, produced at that point, to at least partially reduce the deviation caused by the braking element 5, as indicated by the arrows pointing downward in FIG. 2C. While the deviation is being reduced, there is an absorption of kinetic energy and a smoothing down effect is produced on the weft yarn, which is appropriate to prevent weft yarn breakages.

Just after the smoothing down action, obtained through the reduced deviation, and after reduction of the yarn tension peak, the weft yarn Y, which at this point has already practically stopped—as indicated by 0 in FIG. 2D—is no longer able to oppose the braking force; as a result of the highest braking force, the braking element thus moves back into its position of maximum deviation, as shown in FIG. 2B. It is more or less at this time ($t_2$, in FIG. 3C) that the braking force is dropped to the level of a reduced braking force.

In the working step illustrated in FIG. 2E—due to movement of the reed R which leads to pressure of the yarn against the edge of the fabric being woven, and due to changing of the yarn pattern in that point—a tension increase is again produced in the yarn, being anyhow lower than the tension increase produced in response to the tension peak. Due to the tension increase, the reaction force produced in the weft yarn moves the braking element, kept in the position of deviation by the reduced braking force, back into its starting position of no deviation, or into a position close to this position, against the reduced braking force.

Subsequently, as shown in FIG. 2F, the cutting device S is operated to cut off the tensioned weft yarn. This produces a sudden fall of yarn tension. The reduced braking force again causes a further shifting of the braking element 5 into its position of maximum deviation. Friction points are thus created, to prevent backward oscillations or a springback of the weft yarn towards the weft feeder M. At the same time, thanks to the shifting of the yarn deviation brake into its position of maximum deviation, the free weft yarn end in the insertion nozzle N is withdrawn in such a way as to prevent it from colliding with other yarns or from flapping around, thereby getting damaged due to the blowing action of the nozzle N. Thus, in a subsequent phase—before the start of a new weft insertion step—the yarn deviation brake B is again moved back, by the rotation control member 6, into its starting position of no deviation.

The diagrams shown in FIGS. 3A to 3D illustrate the relationship between the weft yarn tension, the movement of the yarn deviation brake B, the current fed by the rotation control member 6, and the control signals to operate the yarn deviation brake.

As shown in FIG. 3A (yarn tension trend, according to the time t or the angle of rotation of the loom), following the action of the stop device 1, towards the end of weft yarn insertion, a very high tension peak is produced (curve 9). The tension peak is then followed by a sudden fall of yarn tension, after which the tension again rises due to movement of the reed; finally, the tension practically drops (down to a minimum level corresponding to the tension produced by the residual tractive force of the insertion nozzle) at the moment of weft yarn cutting.

The continuous curve 9 places in evidence the tension trend without a controllable yarn deviation brake B. The curve 9', drawn in dashes, shows how the yarn deviation brake B reduces the tension peak 9. The insertion is finally concluded some degrees of rotation angle of the main shaft of the loom before 0° (i.e. 360°).

As shown in FIG. 3B, the yarn deviation brake is at first rapidly shifted from its starting position to its position of maximum deviation, and this with the highest braking force (for instance a braking current of 0.7A) or even with a startup current far higher than normal, in order to overcome any possible mechanical or inertial influences (for instance, more than 0.7A for 3 to 9 ms). Following the tension peak in the curve 9, the yarn deviation brake B is at least partially moved back towards its starting position, so as to have an absorption of kinetic energy (tension curve 9' in FIG. 3A), before being again shifted into its position of maximum deviation (as shown in FIG. 3B) due to the highest braking force which continues to act (for instance 0.7A) When the subsequent yarn tension increase occurs, due to movement of the reed, the yarn deviation brake is again caused to move back, by the actual weft yarn, into its starting position, or at least into a position close to the starting position, where—thanks to the already cited reduction control signal X—at time $t_2$ only a reduced braking force (for instance 0.3A to 0.4A) is set. At this point, the weft yarn is tensioned.

Cutting of the weft yarn then takes place, which practically produces a prompt weft yarn tension drop. Under the action of the reduced braking force (for instance 0.3A to 0.4A), the yarn deviation brake rapidly moves back into a position of maximum deviation and, in so doing, it stops the tendency of the weft yarn to spring backward and, furthermore, it withdraws the free weft yarn end. Subsequently, the yarn deviation brake is shifted back into its starting position and it remains in the position for most of the successive weft insertion step.

As illustrated in FIG. 3C, at a time $t_0$, for the proportional rotation magnet forming the control member 6 of the yarn deviation brake B, a maximum startup current $I_1$, (for instance over 0.7A) is set, so as to rapidly shift the yarn deviation brake into a position of maximum deviation. In the case of a heavy or thick quality yarn, the current $I_1$, is maintained up to a time $t_2$, in that such a heavy quality weft yarn is anyhow apt to move back the yarn deviation brake, at least partially, towards its starting position of no deviation, even in the presence of the highest braking force, when the tension peak occurs, so as to reduce its effects. Whereas, in the case of a lighter quality yarn, at time $t_1$ (for instance after 3 to 9 ms), the startup current $I_1$ is reduced to the current $I'_1$ (for instance to 0.7A), so as to put the light quality weft yarn in the condition to move back, at least partially, the yarn deviation brake towards its starting position of no deviation, when the tension peak occurs. The current $I'_1$, equally as the startup current $I_1$, is however so strong that the highest braking force produced by it is substantially higher than the reaction force which the weft yarn can oppose during the subsequent motion of the reed, under the effect of the tension increase. For this reason, a reduction control signal X is generated at time $t_2$ and the current $I_2$ is consequently regulated, this current being substantially weaker than the startup current $I_1$ or than the actual current $I'_1$ (for instance, only 0.3A to 0.4A). The time $t_2$ is sufficiently spaced from the time $t_s$, the time at which the weft yarn is cut. The current $I_2$ is kept beyond the time $t_s$ until, after the free cut weft yarn end has been duly withdrawn, the current $I_3$ (a negative current) is set at time $t_3$, this last current being apt to move back the yarn deviation brake actively to its starting position of no deviation. To carry out the aforedescribed working steps, the curve of the current trend 11 (FIG. 3C) is adapted to the conditions or parameters depending on the yarn quality, on the type of loom and on the operating modes of the system.

As shown in FIG. 3D, to reduce the current to $I_2$ at time $t_2$ the reduction control signal X is derived from the signals to draw the yarn turns, or of yarn unwinding, issued by the sensor 3 of yarn passage positioned on the weft feeder M. More exactly, the reduction control signal X is derived from a predetermined signal (for instance, from the signal c) forming part of the signals a, b, c, to draw the yarn turns, generated in sequence. Furthermore, as soon as the preselected signal c to draw the yarn turns is generated, one takes into account a predetermined delay time d, so as to generate the reduction control signal X exactly in correspondence of the time $t_2$, namely in correspondence of a specific angle of rotation of the loom, that is, after the tension peak has been reduced due to braking and sufficiently in advance in respect of the time $t_s$ when the weft yarn is cut. The reduction control signal X could be generated by the loom D—by way of the signal transducer 8, as a function of a predetermined position of rotation, for instance of the main shaft of the loom—and/or by the device for the control and operation of the loom.

An embodiment of the method starts from the assumption to continue applying, for weft yarn control at the end of insertion, only a fraction of the braking force already set previously, to allow the subsequent automatic operation of the yarn deviation brake.

A further embodiment of the method ensures that the weft yarn reaction force, due to movement of the reed, automatically moves back the yarn deviation brake into the starting position of no deviation, or at least into a position close to the starting position, so that, for the final braking, after cutting, and for the withdrawal of the free weft yarn end, use can be made of an ideally wide stroke of the yarn deviation brake.

An additional embodiment of the method ensures a sufficiently prompt and precise operation of the yarn deviation brake to cause the shifting of the brake during a weft insertion step. Of the highest braking force applied at first, only a fraction is kept for the subsequent requirement to brake the yarn after cutting and to withdraw the free weft yarn end. This proves to be more advantageous than creating again a braking force from naught, even though low.

Another embodiment of the method obtains a behavior of the yarn deviation brake which causes its operation to have an immediate response. The startup current allows reliably overcoming any mechanical and inertial influence.

Another additional embodiment of the method obtains a reduced braking force through a signal for drawing the yarn turns issued from the weft feeder; this proves to be simple and precise for this technique of control and operation. The signal to draw the yarn turns, with a delay time preferably added for a reduction control signal, represents the position of the weft yarn in the yarn path and in the shed, starting from which a new yarn tension increase will be produced due to movement of the reed, so that, for further reliability of the method, the reduction control signal may require a sufficient lapse of time before cutting.

Alternatively, the reduced braking force could also be obtained with a signal external to the loom (or to the device for the control and operation thereof, and/or according to the position, by means of an encoder); and in a specially advantageous way, with a particularly simple external signal of derivability.

The weft yarn deviation brake may make use of a proportional rotation magnet which allows an extremely precise adjustment of the braking force, or of the reduced braking force, and which reacts in a practically immediate way to control the current regulation circuit, or current reduction for the reduced braking force.

What is claimed is:

1. A method for controlling weft yarn insertion in a loom, the method comprising the steps of:

braking the weft yarn (Y) being inserted into the loom (D) as the end of weft yarn insertion approaches with a braking force applied by a controllable yarn deviation brake (B) positioned between a weft feeder (M) and a warp shed (F) of the loom (D) and causing a deviation of the yarn deviation brake (B) from a starting position;

reducing a tension peak of the weft yarn (Y) while reducing the deviation of the yarn deviation brake (B) towards the starting position by using a tension of the weft yarn (Y) so as to press the weft yarn (Y) against an edge of fabric being woven by a reed (R); and cutting the weft yarn (Y) inserted in the warp shed (F) to a first length;

wherein, after the steps of braking the weft yarn and reducing the tension peak and while inserting the weft yarn, the braking force of the yarn deviation brake (B) is reduced to a reduced braking force correlated to a yarn tension value which prevails up to the cutting step.

2. Method as in claim 1, further comprising, after said cutting step, the step of braking the weft yarn (Y) by a deviation of the yarn deviation brake (B), wherein the yarn deviation brake (B) automatically reacts to a decrease in tension of the yarn (Y) after said cutting the weft yarn step.

3. Method as in claim 1, further comprising the steps of:

setting the reduced braking force to a fractional braking level corresponding only to a fraction of a highest braking forces; and keeping the reduced braking force at the fractional braking level until after said cutting the weft yarn step.

4. Method as in claim 1, further comprising the step of setting the reduced braking force to be weaker than a weft yarn reaction force active in the yarn deviation brake, wherein the weft yarn reaction force is determined by an increase of yarn tension due to a movement of the reed.

5. Method as in claim 4, further comprising the step of correlating the reduced braking force to the weft yarn reaction force, so that the weft yarn moves the yarn deviation brake to a position proximal to the starting position of no deviation prior to said cutting the weft yarn step.

6. Method as in claim 1, further comprising the steps of:

controlling the yarn deviation brake (B) by an electromagnetic actuator (6) having proportional rotation so as to be shifted between the starting position, corresponding to no yarn deviation, and a position of maximum deviation and braking;

setting a shifting force of the electromagnetic actuator (6) to depend on one of a current fed and a voltage applied to the electromagnetic actuator; and feeding the electromagnetic actuator (6) with a reduced braking current which is less than a current corresponding to a highest braking force, said feeding step being performed for an entire duration of the reduced braking force.

7. Method as in claim 6, further comprising the step of feeding the electromagnetic actuator with a controlled start-up current greater than the reduced braking current prior to said step of feeding the electromagnetic actuator with a reduced braking current.

8. Method as in claim 6, further comprising the step of regulating the reduced braking current for the reduced braking force with a reduction control signal (X) derived from a predetermined signal for drawing the yarn turns from the weft feeder, wherein the reduction control signal (X) is generated according to a movement of weft yarn insertion and the reduction control signal (X) has a predetermined delay time according to a specific condition of the system.

9. Method as in claim 6, wherein said feeding the electromagnetic actuator with a reduced braking current step is regulated with an external reduction control signal (X) external to the loom.

10. Method as in claim 9, further comprising the step of generating the external reduction control signal (X) when a main shaft of the loom reaches a specific position of rotation.

11. A weft yarn deviation brake in a loom, the brake comprising:

a braking element shifted between a starting position of no yarn deviation and an intermediate position of yarn deviation that is between the starting position and a maximum yarn deviation position;

a drive actuator for controlling said braking element during insertion of a weft yarn in a loom, said drive actuator comprising a proportional rotation magnet (6) which can be shifted bidirectionally and a current adjustment circuit (7) for adjusting a current for said proportional rotation magnet (6) to different current levels, said current adjustment circuit (7) being connected to a transducer (8, C, CU) for generating a reduction control signal (X) causing said current adjustment circuit (7) to adjust and maintain a braking current supplied to said drive actuator, wherein after a first current intensity, a lower current intensity lower than the first current intensity is supplied to said drive actuator to provide a reduced braking force, the lower current intensity in said drive actuator being correlated to a weft yarn tension prevailing up until the weft yarn is cut at an end of weft yarn insertion, the lower current intensity in said drive actuator being maintained until the weft yarn is cut and the weft yarn deviation brake (B) first moves in a direction towards the starting position when a yarn tension rise occurs during a beat-up operation of a reed (R), the weft yarn deviation brake (B) further moving so as to withdraw and brake the weft yarn in a direction opposite to the insertion direction of the weft yarn after being cut during a period of the reduced braking force.

* * * * *